United States Patent [19]

Haynes et al.

[11] 3,977,149

[45] Aug. 31, 1976

[54] MULTIPURPOSE CONSTRUCTION PANEL

[75] Inventors: Harvey H. Haynes, Camarillo, Calif.; Gene S. Guthrie, Springfield, Va.

[73] Assignee: The United States of America as represented by the Secretary of the Navy, Washington, D.C.

[22] Filed: Mar. 28, 1975

[21] Appl. No.: 563,081

[52] U.S. Cl. ..... 52/731; 52/86

[51] Int. Cl.[2] ..... E04C 3/30

[58] Field of Search ..... 52/86, 731, 220, 249, 52/495, 241, 579

[56] References Cited

UNITED STATES PATENTS

| | | | |
|---|---|---|---|
| 1,924,881 | 8/1933 | Ragsdale | 52/731 X |
| 2,082,792 | 6/1937 | Dean | 52/731 |
| 2,097,484 | 11/1937 | Winslow | 52/731 X |
| 3,059,734 | 10/1962 | Tripp | 52/86 |
| 3,332,179 | 7/1967 | Toti | 52/731 X |
| 3,387,418 | 6/1968 | Tyrer | 52/731 X |

FOREIGN PATENTS OR APPLICATIONS

| | | | |
|---|---|---|---|
| 118,810 | 2/1970 | Norway | 52/731 |

*Primary Examiner*—J. Karl Bell

*Attorney, Agent, or Firm*—Richard S. Sciascia; Joseph M. St.Amand; Darrell E. Hollis

[57] ABSTRACT

A rigid ferro-cement construction panel comprising a plurality of U-shaped sections adjoined in abutting relationship such that the cross-section across the length thereof is in the shape of a square wave. The construction panel may be interfitted with other similar construction panels to form larger structures.

5 Claims, 18 Drawing Figures

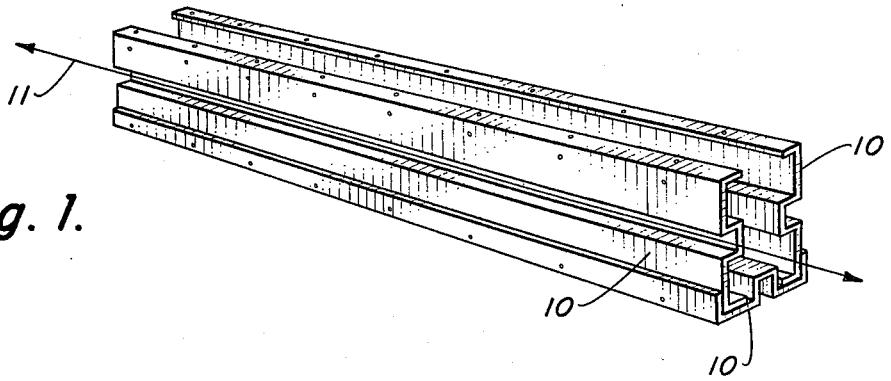
Fig. 1.
Fig. 2.
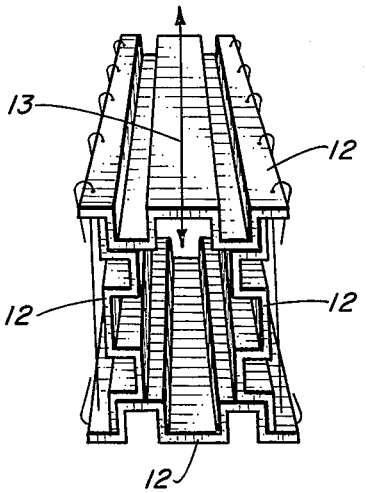
Fig. 3.
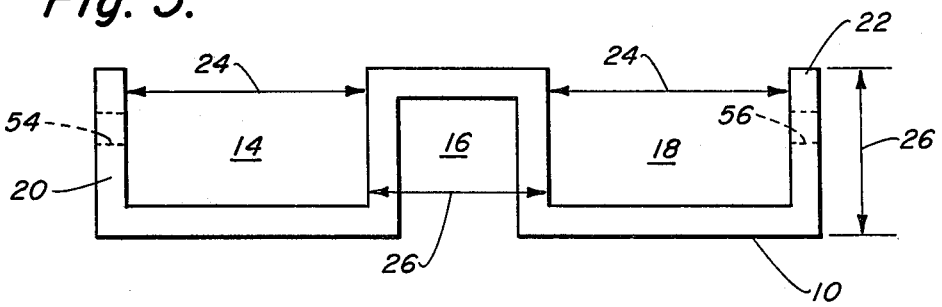
Fig. 4.
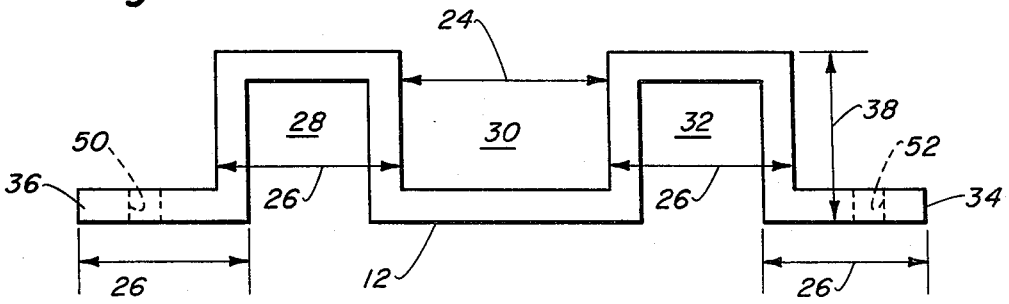

HOLLOW BEAM, HOLLOW COLUMN, OR PERMANENT FORM FOR CONCRETE COLUMN

TWO-LAYER ROOF OR WALL

PERMANENT FORM FOR CONCRETE BEAM

BEAM

METHODS OF MAKING RIGHT ANGLE CONNECTION

HOLLOW BEAM, HOLLOW COLUMN, OR PERMANENT FORM FOR CONCRETE COLUMN

PERMANENT FORM FOR CONCRETE BEAM

TWO-LAYER ROOF OR WALL

TWO-LAYER ROOF OR WALL

METHOD OF MAKING A RIGHT ANGLE CONNECTION

MULTIPURPOSE CONSTRUCTION PANEL

BACKGROUND OF THE INVENTION

1. Field of the Invention

This invention relates generally to construction members and more particularly to construction members capable of being interfitted with similar construction members to form a multiplicity of larger structures.

2. Description of the Prior Art

Although many efforts have been made in the past to develop various types of prefabricated building components, most if not all, of the efforts have been directed towards the manufacture of wall sections and other relatively large components each of which requires a different pattern and different manufacturing procedures. In addition, efforts have been made in the past to develop small light-weight construction panels which may be utilized in the fabrication of a multiplicity of larger structures. However, these construction members suffer from the complexity of their interfitting means and procedures. In addition, such construction members require extensive and complex manufacturing procedures.

SUMMARY OF THE INVENTION

In accordance with one embodiment of the present invention, a construction panel is formed with a series of rigid U-shaped sections adjoined in abutting relationship such that the cross-section across the length thereof is in the shape of a square wave. The construction panels may be interfitted with other similar construction panels to form large structures.

Accordingly, one object of the present invention is to provide a new and improved construction panel which is capable of being used as a prefabricated building component and each of which may be made from the same pattern and with the same manufacturing procedures.

Another object of the present invention is to provide a new and improved construction panel, a plurality of which can be used to form a larger structure.

A further object of the present invention is to provide a construction panel easily interfitted with similar construction panels utilizing conventional fasteners.

Another object of the present invention is to provide a construction panel that can be worked in the field utilizing portable power hand tools.

A still further object of the present invention is to provide a construction panel that can be manufactured by hand labor, by semi-automated processes or by a fully automated process.

Another object of the present invention is to provide a construction panel that possesses considerable strength.

Another object of the present invention is to provide a construction panel which is fire resistant and capable of exposure to corrosive environments without degradation in the strength of the construction panel.

One other object of the present invention is to provide small inexpensive and reliable construction panels.

Another object of the present invention is to provide construction panels that are easily interfitted.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

BRIEF DESCRIPTION OF THE DRAWINGS

FIG. 1 is an isometric view illustrating a permanent form work for a concrete beam incorporating therein the construction panels of the present invention.

FIG. 2 is an isometric view illustrating a permanent form work for a concrete column incorporating therein the construction panels of the present invention.

FIG. 3 is a cross-sectional view of an individual construction panel of FIG. 1 taken across the longitudinal axis thereof.

FIG. 4 is a cross-sectional view of an individual construction panel of FIG. 2 taken across the longitudinal axis thereof.

DESCRIPTION OF THE PREFERRED EMBODIMENT

Figure 5A:
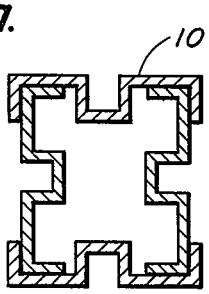
FIG. 5 illustrated several methods of interfitting the individual construction panel illustrated in FIG. 3.
Figure 5B:
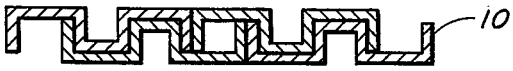
Figure 5C:
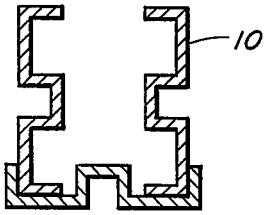
Figure 5D:
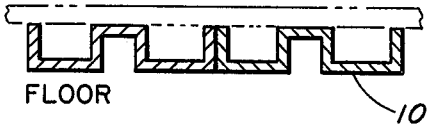
Figure 5E:
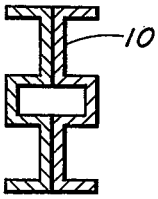
Figure 5F:
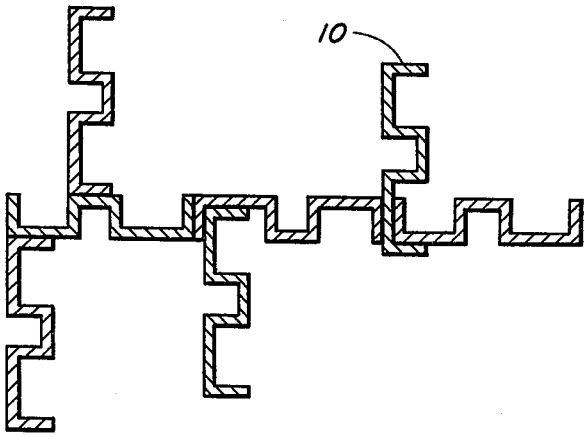
Figure 6A:
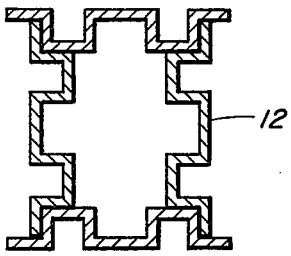
FIG. 6 illustrates several methods of interfitting the individual construction panel illustrated in FIG. 4.
Figure 6B:
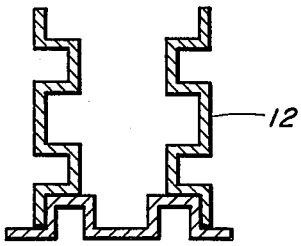
Figure 6C:
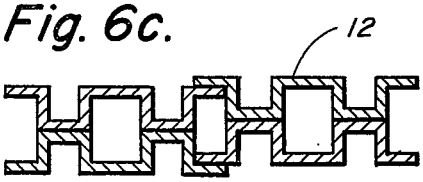
Figure 6D:
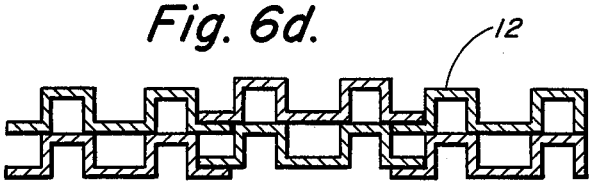
Figure 6E:
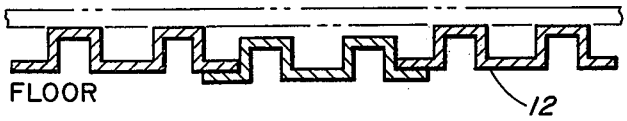
Figure 6F:
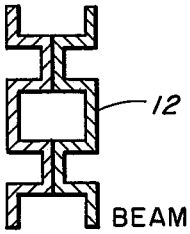
Figure 6G:
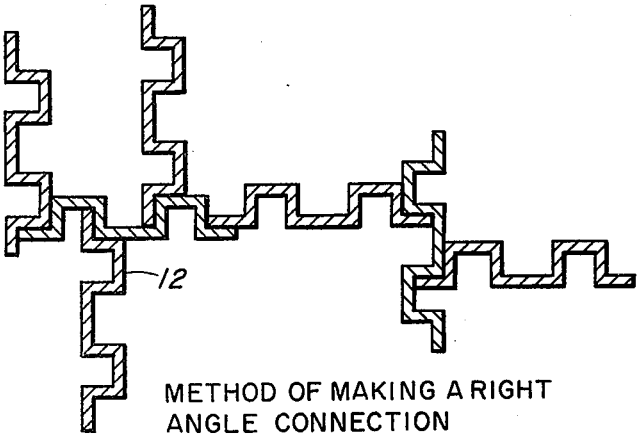
Figure 6H:
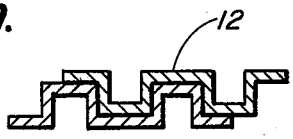

FIG. 1 illustrates three construction panels 10 interfitted to form a permanent form work for a concrete beam. FIG. 2 illustrates four construction panels 12 interfitted to form a permanent form work for a concrete column. The longitudinal axis of a construction panel 10 of FIG. 1 is designated by numeral 11. The longitudinal axis of a construction panel 12 of FIG. 2 is designated by numeral 13.

Now turning to FIG. 3, an individual construction panel 10 is illustrated in cross-sectional view taken across longitudinal axis 11. Construction panel 10 is comprised of three rigid U-shaped sections 14, 16 and 18. U-shaped sections 14, 16 and 18 are adjoined in abutting relationship such that the cross-section across the longitudinal axis of construction panel 10 is in the shape of a square wave. Located at one end of construction panel 10 is an edge member 20. Edge member 20 is disposed vertically with respect to the plane of construction panel 10. Edge member 20 forms part of U-shaped section 14. Located at the other end of construction panel 10 is edge member 22. Edge member 22 is vertically disposed with respect to the plane of construction panel 10. Edge member 22 forms part of U-shaped section 18. It is noted that adjoining U-shaped sections have common members as illustrated in FIGS. 3 and 4.

The interior widths 24 of U-shaped sections 14 and 18 are wider than the exterior widths 26 of U-shaped section 16. It is noted that the heights of U-shaped sections 14, 16 and 18 are equal to the exterior width 26 of U-shaped section 16. The differences in widths between width 24 and width 16 permit the nesting of a U-shaped section or edge member of one construction panel 10 into a U-shaped section 14 or 18 of a second construction panel 10 as illustrated in FIG. 5*a* and *b*.

As shown in FIG. 3, the U-shaped sections alternate in width between width 24 and width 16. Of course, for certain special purposes or applications, it is envisioned that each U-shaped section may have identical or different widths. In addition, the construction member 10 of FIG. 3 shows only three U-shaped sections.

It is envisioned that construction panel 10 of FIG. 3 may have as many U-shaped sections as are necessary for the desired application.

Now turning to FIG. 4, a cross-section of an individual construction panel 12 of FIG. 2 taken across longitudinal axis 13 is illustrated. Construction panel 12 comprises U-shaped sections 28, 30 and 32 as well as edge members 34 and 36. U-shaped sections 28 and 32 have exterior widths 26. U-shaped section 24 has an interior width 30. U-shaped sections 28, 30 and 32 are of identical heights 38. Edge members 34 and 36 have exterior widths 26. Edge members 34 and 36 are horizontally disposed with respect to the plane of panel 12. Interior width 24 of U-shaped section 30 is larger than exterior width 26 of U-shaped sections 28 and 32 and edge members 36 and 34 so that edge members 34 and 36 or U-shaped sections 28 and 32 may nest within similar edge members or U-shaped sections of other construction panels 12 as illustrated in FIG. 6.

Holes 50 and 52 of FIG. 4 and holes 54 and 56 of FIG. 3 provide access for fasteners. It is envisioned that conventional means of joining panels together will be utilized, e.g., nails, forced-entry fasteners, bolts and nuts, pop-rivets, and adhesive bonding. For applications requiring water-tightness, adhesive bonding may be sufficient alone or zinc-chromate compounds may be utilized in conjunction with mechanical fasteners.

It is envisioned that construction panels 10 and 12 will be fabricated with ferro-cement. Ferro-cement, as is well known to those having ordinary skill in the art, is a term applied to a highly steel reinforced portland cement mortar. Structural tests on ferro-cement construction panels have shown that when compared to wood, ferro-cement has a slightly lower live-load-to-dead-weight ratio in flexure, less deflection, and higher allowable compressive load carrying ability (parallel to the longitudinal axis). In general ferro-cement is similar to wood in strength characteristics. Ferro-cement is superior to wood in its durability and fire resistance characteristics. In addition, ferro-cement exhibits excellent durability in marine and tropical environments which means longer service life for the structure. Wood rots quickly and steel requires considerable maintenance. Ferro-cement has the durability of a concrete material and can withstand hostile environments. The steel reinforcement is protected from corrosion by the high alkalinity (high pH content) of the mortar mix. Alternative construction materials include among others, polymer impregnated materials, glass reinforced resin materials and metal alloys.

It is noted that construction panels 10 and 12 of FIGS. 3 and 4 are eight feet in length to correspond to a standard U.S. dwelling wall height and 12-inches wide. Of course, this width and length were chosen for convenience only. Other varied lengths and widths may be utilized in the fabrication of construction panels 10 and 12. Construction panels 10 and 12 may be utilized to form the following structures, among others: bunkers, fox-hole covers, revetments, armor plating for existing structures, protective barriers for bridge piers, helicopter landing pads, dead-man anchors, retaining walls, piles, sheet pilings, coffer dams, quay walls, canal linings, water tanks, water cisterns, rafts, sandpans, personnel shelters, warehouses, sewage tanks, shower stalls, foundations, walls, floors, roofs, built-up columns, built-up beams and forms for concrete. FIGS. 5 and 6 illustrate various methods of interconnecting construction panels 10 and 12 to form various constructions.

Obviously numerous modifications and variations of the present invention are possible in light of the above teachings. It is therefore to be understood that within the scope of the appended claims the invention may be practiced otherwise than as specifically described herein.

What is claimed is:

1. A construction panel comprising a plurality of rigid U-shaped sections adjoined in abutting relationship such that the cross-section across the length thereof is in the shape of a square wave, said sections operable to be interfitted with U-shaped sections from similar construction panels to form large structures having right angle walls therein, all said U-shaped sections being of equal height, said square wave shape of said abutting U-shaped sections terminating at both ends with an edge member disposed horizontally with respect to the plane of said construction panel.

2. The construction panel of claim 1 wherein the widths of said U-shaped sections horizontally along said square wave shape alternate between a first width and a second width, except that each said horizontal edge member and its abutting U-shaped section both are said second width.

3. The construction panel of claim 2 wherein the widths of said U-shaped sections are such that an exterior width of said second width U-shaped section is operable to nest within an interior width of said first width U-shaped section making it possible for the panels to interfit horizontally as well as at right angles so as to form right angle connections, beams, floors, roofs, walls, columns, revetments, and various additional structural components.

4. The construction panel of claim 2 wherein said construction panel comprises three U-shaped sections and said two horizontal edge members, said edge members and abutting U-shaped sections being said second width, said other U-shaped sections being said first width, said first width being longer than said second width.

5. The construction panel of claim 1 wherein said construction panel is fabricated from ferro-cement.

* * * * *